US007114825B1

(12) United States Patent
Bauman

(10) Patent No.: US 7,114,825 B1
(45) **Date of Patent: *Oct. 3, 2006**

(54) MULTIFUNCTION UTILITY TOOL

(76) Inventor: Evan George Bauman, 2241 Del Monte, Houston, TX (US) 77019

( * ) Notice: Subject to any disclaimer, the term of this patent is extended or adjusted under 35 U.S.C. 154(b) by 103 days.

This patent is subject to a terminal disclaimer.

(21) Appl. No.: 10/962,035

(22) Filed: Oct. 8, 2004

Related U.S. Application Data

(60) Provisional application No. 60/509,954, filed on Oct. 9, 2003.

(51) Int. Cl.
*B25B 23/18* (2006.01)

(52) U.S. Cl. ..... 362/119; 362/253; 7/108; 7/165; 7/168

(58) Field of Classification Search ..... 362/119, 362/120, 253; 7/107, 108, 158, 165, 167–170, 7/118, 119
See application file for complete search history.

(56) References Cited

U.S. PATENT DOCUMENTS 5,062,173 A 11/1991 Collins ..... 7/118
5,653,525 A * 8/1997 Park ..... 362/119
5,664,274 A 9/1997 Collins ..... 7/129
6,273,582 B1 * 8/2001 Taggart et al. ..... 362/119
6,352,010 B1 * 3/2002 Giarritta et al. ..... 81/177.4
2004/0016058 A1 * 1/2004 Gardiner et al. ..... 7/119

* cited by examiner

*Primary Examiner*—Renee Luebke
*Assistant Examiner*—Gunyoung T. Lee
(74) *Attorney, Agent, or Firm*—Wendy Buskop; Buskop Law Group, P.C.

(57) ABSTRACT

The invention is a multiple function tool for use with computer systems made of a housing having a cover plate and a back plate connected by a plurality of rivets, as a unit, a plurality of implements connected to a housing, wherein the plurality of implements include a flashlight, a chip puller, a first screwdriver having a small Phillips head, a second screwdriver forming a small flat head, a continuity tester with an indicator light, a wire stripper, a crimper, and a laptop case cracker, wherein the plurality of implements are pivotably coupled to the plurality of rivets and the flashlight is positioned on the cover plate.

17 Claims, 5 Drawing Sheets

MULTIFUNCTION UTILITY TOOL

The present application claims priority to co-pending U.S. Provisional Patent application Ser. No. 60/509,954 filed on Oct. 9, 2003.

FIELD OF THE INVENTION

The invention relates to a multi-purpose tool. More particularly, the invention relates to such tools that provide several useful items to assists a person in performing a number of different functions including functions associated with the use of computer equipment.

BACKGROUND OF THE INVENTION

Computer repair and service persons have been carrying around tools in belts and filling briefcases with an assortment of tools required for performing their work. This has made it cumbersome to have the right tool at the right moment.

A number of multi-purpose tools have been proposed. For example, Collins U.S. Pat. No. 5,062,173 and collins U.S. Pat. No. 5,664,274 disclose tools including a plurality of implements for performing cutting and other functions. However, neither of those multi-purpose tools includes the requisite tools for performing the necessary functions associated with fixing computer boxes at a customers location, nor for additionally fixing network components, servers or auxiliary equipment such as fax machines and wiring built into an office, and, therefore these other tools are unacceptable for such applications.

Accordingly, it will be apparent that there continues to be a need for a multi-purpose tool that provides various implements for performing many functions associated with computer servicing at a customer location, including fixing laptop, upgrade a memory card, wiring a network, or installing wireless communications. Furthermore, the need exists for such a device that is relatively compact so that it does not in any way hinder or burden a person who is engaged in such repair and maintenance. The present invention addresses these needs and others.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
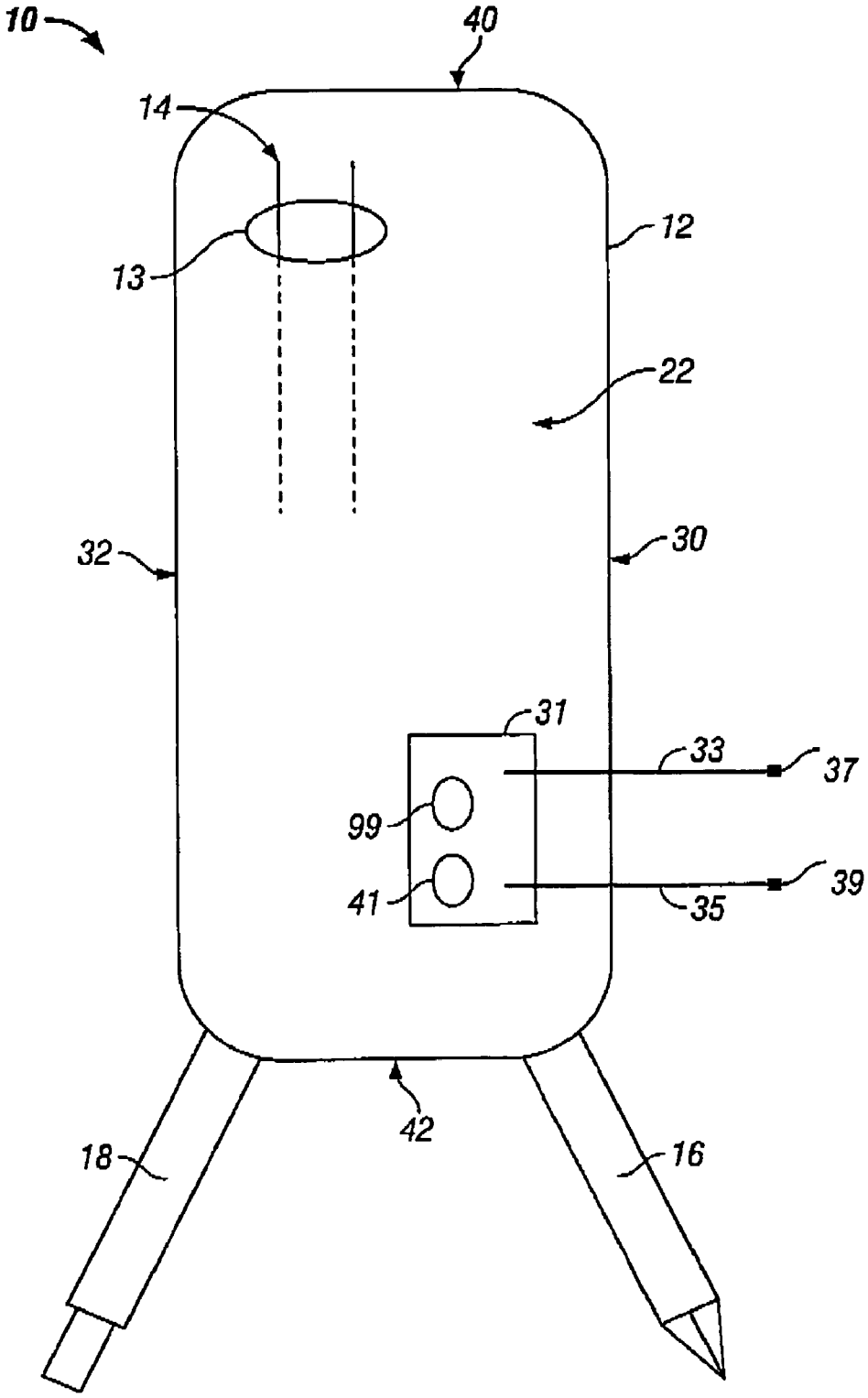
FIG. 1 is a view of a front plate cover.

While this invention has been described with emphasis on the preferred embodiments, it should be understood that within the scope of the appended claims, the invention might be practiced other than as specifically described herein.

Briefly, and in general terms, the present invention provides a, portable multi-purpose tool for use by a person engaged in computer repair at a customers location, and other locations, to perform various tasks performed on equipment associated with computer networks, computer hardware and related equipment such as fax machines and auxiliary components which communicate with computers. The multi-purpose tool of the present invention includes various implements that are conveniently contained in a housing, and are selectively extendable and pivot from the housing into respective operating positions for use. Due to the compact nature of the tool, the tool may be readily carried to any location without the tool being a burden or hindrance to the person carrying the tool during, repairs, installation or maintenance of, computers, the network, or any related computer function.

The advantages of the present invention will be readily apparent from the following detailed description of the invention, taken in conjunction with the accompanying drawings that illustrate, by way of example, features of the present invention.

In the following detailed description, like reference numerals will be used to refer to the corresponding elements in the different figures of the drawings.

With reference to the Figures, FIG. 1 is a first embodiment of a multi-purpose tool 10 formed in accordance with the principles of the present invention. The Multi-purpose tool 10 has a plurality of additional tools coupled thereto for performing various functions associated with repair of computer equipment, maintenance of networks, and repair and installation of communication equipment such as laptops, fax machines, cash registers, bar scanners, credit card terminals, and the like.

The multi-purpose tool comprises a housing 12 configured to house various combinations of tools and implements that are useful in connection with repair, installation, and maintenance of computer networks, computers, and related equipment.

In a preferred embodiment shown in FIG. 1 there is a front cover plate 22, a housing 12 is formed with a plurality of recesses shaped to receive the tools or implements to be housed by the housing 12. For example, a chip puller 14 can be mounted in the housing 12 in a recess 13 and the chip puller can slide out of the recess. Recess 13 is a generally cylindrical opening into which a chip puller 14 can be generally stored. In FIG. 1, the ends of the housed chip puller are shown slightly extended. A first screwdriver having a small Phillips head 16 can each be pivotably mounted to the housing. A second screwdriver having a small flat head 18 can also be mounted in the housing 12. Also shown is a first longitudinal side 30 and second longitudinal side 32. Housing 12 has a first end 40 and a second end 42. Preferably, these ends have rounded corner.

A continuity tester 31 with an indicator light 41 is secured to the housing 12. In one embodiment the tester includes a first retractable wire 33 and a second retractable wire 35. Each wire has a contact. First contact 37 is for first retractable wire 33 and second contact 39 is for second retractable wire 35. The contacts connect to the second indicator light 99 to indicate signal continuity in a part or circuit to be tested.

Figure 2:
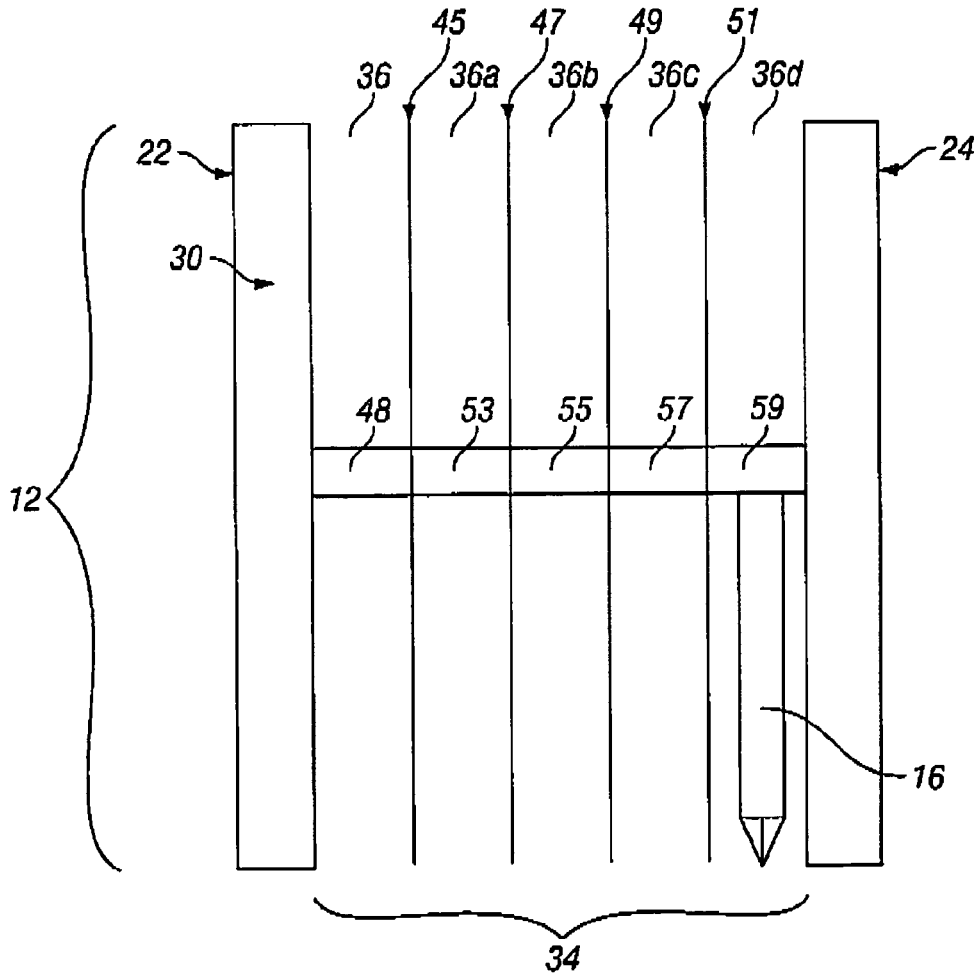
FIG. 2 is a detail of the first longitudinal side of the invention showing the interior plates.

FIG. 2 shows a side view of the invention showing that the housing 12 preferably includes a front cover plate 22 and a back cover plate 24, each of which is preferably elongated, with a generally rectangular cross section. The first longitudinal side 30 includes a longitudinal openings 34. The longitudinal openings 34 shown in FIG. 2 have recesses 36, 36*a*, 36*b*, 36*c*, 36*d*, within housing 12 in which one or more implements or tools may be stored. Similarly, longitudinal side 32 has a second recess that is not shown similar to the first recess 36.

Housing 12 may include a number of additional plates 45, 47, 49, 51 interposed between respective front and back cover plates 22, 24. These plates 45, 47, 49, and 51 are cross-sectional shapes such that housing 12 includes the respective recesses 36, 36*a*, 36*b*, 36*b*, and 36*d* for receiving implements, as described in greater detail below. The respective cover plates 22, 24 of housing 12 are preferably joined together by rivets and have spacers between the plates 48, 53, 55, 57, 59 where the rivets extend through the respective cover plates 22, 24 and any additional plates there between. Some of the rivets, in addition to securely holding the plates together, server as pivot pins for various pivotably mounted implements, as described below. The rivets that do not serve as pivot pins can be 2.5 mm in diameter, but preferably 4 mm in diameter to provide additional strength for the pivotable mounting.

The first screwdriver 16 preferably is pivotably mounted to the housing 12 via a rivet 48, 53, 55, 57, or 59. Rotation of the screwdriver 16 about its pivot pin 59 permits selective orientation of screwdriver 16 for use. The second screwdriver 18 not shown in FIG. 2 can be pivotably mounted in the same fashion to housing 12.

Figure 3:
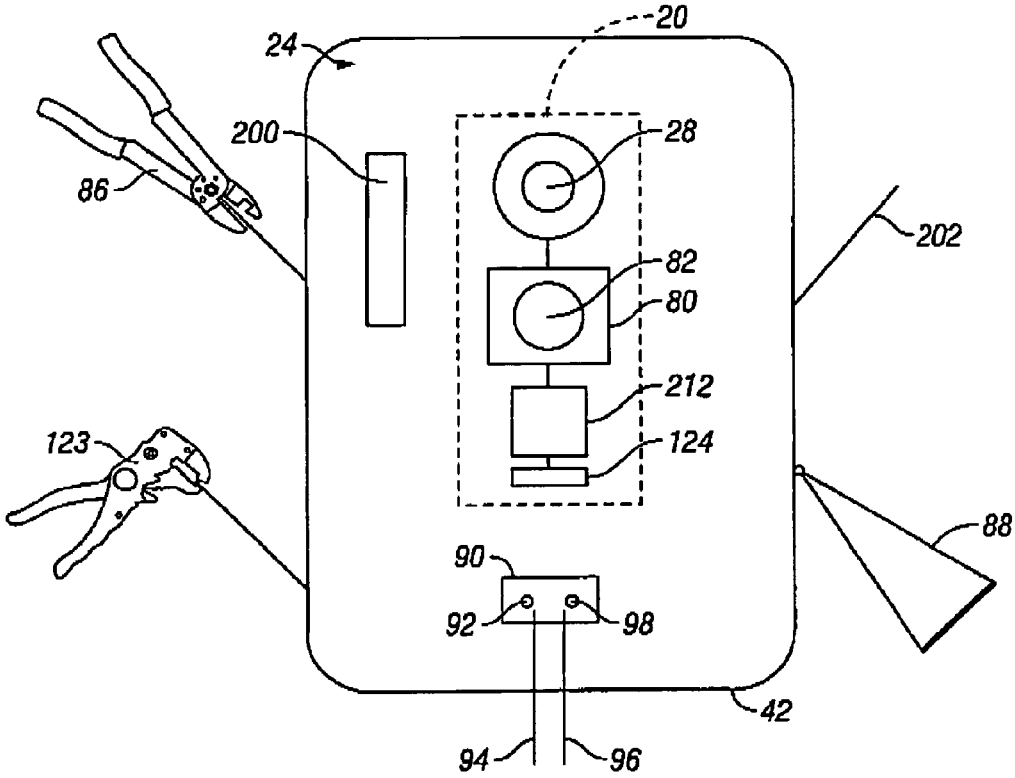
FIG. 3 is a detail of the back view of the invention.

FIG. 3 depicts the back cover plate 24 of the tool. The tool can include a flashlight 20. The flashlight 20 can be have a compartment 80 for receiving a battery 82. It is expected that the flashlight and the battery are oriented with respect to each other such that the longitudinal axis of a bulb 28 provided in the flashlight is perpendicular to the longitudinal axis of battery 82.

A wire stripper 123 is an implement usable with this invention. It is preferred that the wire stripper be for 24 gage or smaller wire. A crimper 86, which can be a wire crimper used for stripping solid or stranded wire, and is adapted for Ethernet and telephone cable crimping. A laptop case cracker 88 is used to pry open a computer case without damage, and is included and contemplated as a implemented for this tool.

Additionally, an Ethernet connector tester 90 with a connector 92 having a first lead 94 and a second lead 96 and a light indicator 98 for indicating a working Ethernet connection can be built into the tool for indicating a working circuit. It is preferred that the light indicator would be an LED light. A preferred connector would be the well-known RJ45 connector. It is preferred that the connector tester be pivotably coupled to the tool such that pivoting of the test away from the tool permits access to the connector interior. A password mnemonic 200 can be mounted on the back cover of the tool. Additionally the device can have a cable pin insertion device 202 that can fold into one of the recesses.

Returning to the flashlight shown in FIG. 3, the flashlight can include a flashlight actuator 212 arranged for activating and deactivating the flashlight. In addition, the flashlight can also include a reflector 124 for reflecting on the face of the multiple function tool.

Figure 4:
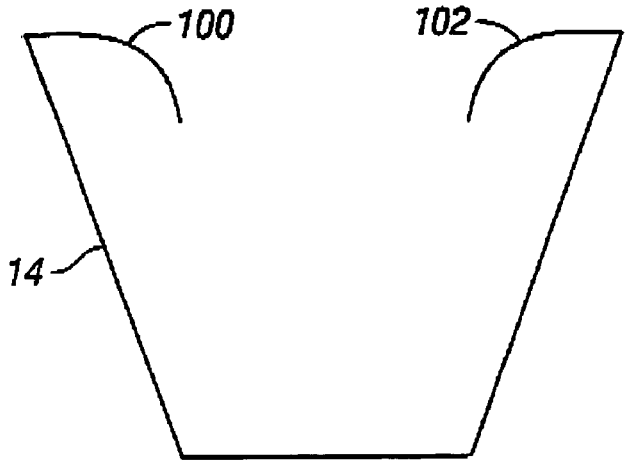
FIG. 4 is a side view of a chip puller used in the invention.

FIG. 4 shows the chip puller used in the invention. In a preferred embodiment, a chip puller 14 containable in recess 13 shown in FIG. 1. The chip puller 14 has a form similar to a pair of tweezers with hooks 100, 102 on the end. Generally, the chip puller is a pseudo-cylindrical shape when in the closed position. In an alternative embodiment, the chip puller could be pivotably mounted to the interior of the housing 12 for rotation from the recesses 36.

Figure 5:
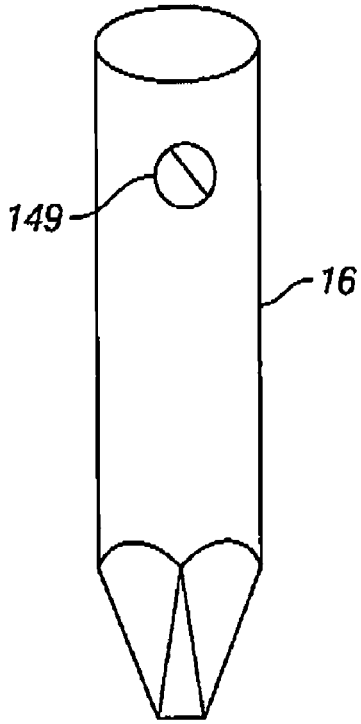
FIG. 5 is a side view showing how a screwdriver of the invention is mounted to the body of the tool.

FIG. 5 is a side view showing how a screwdriver 16 of the invention with a slot 149 for attaching to the plate, using a rivet through the slot 149.

Figure 6:
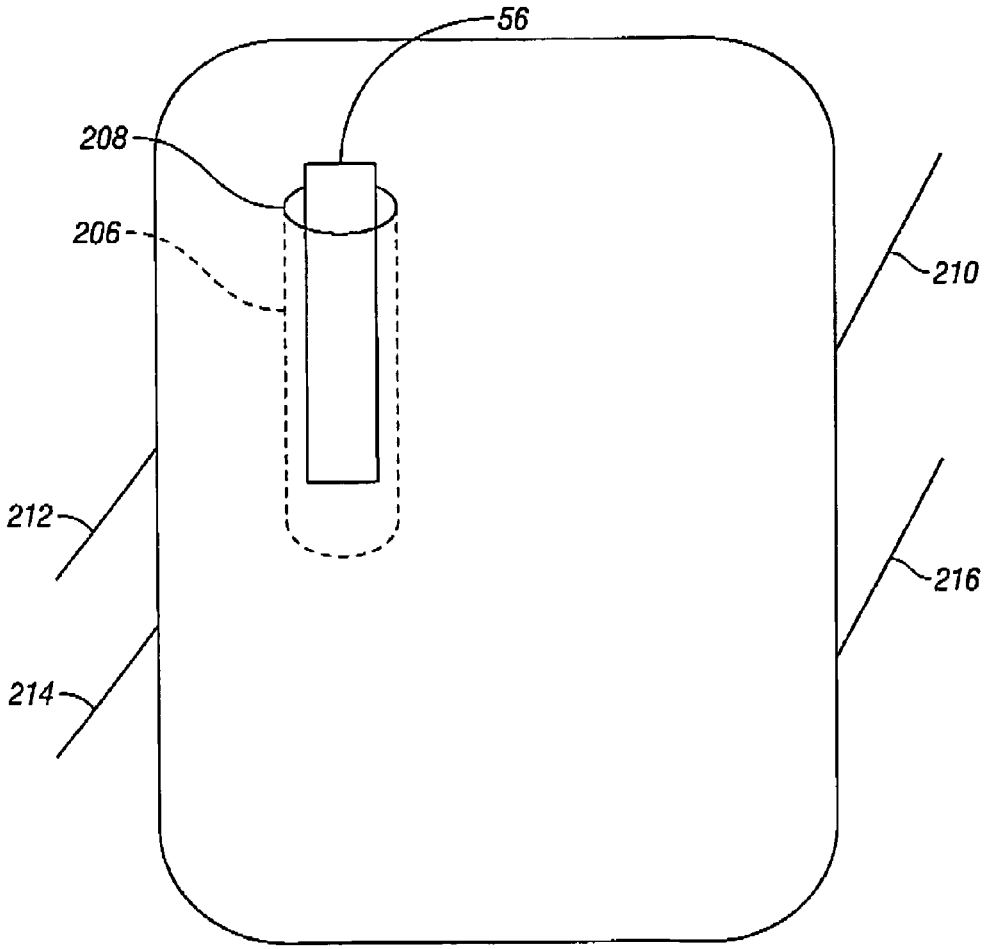
FIG. 6 is a view of a second cover plate of the invention with certain tools deployed.

FIG. 6 shows the tool can include a removable implement, such as a writing implement 56. In this embodiment, the tool would have a slot 206 with an opening 208 for storing the writing implement, shown in FIG. 6.

It is also contemplated that the tool could include additional deployable implements pivotably secured to the tool that is at least one of the group consisting of a cutting blade 210 and a cap lifter 212. The invention also contemplates having pivotably mounted a third screwdriver forming a large flat head 214 and a torx screwdriver 216.

While a multi-purpose tool formed in accordance with the principles of the present invention is particularly shown and described herein with reference to particular embodiments, it is to be understood that the invention may be used with many additions, substitutions, or modifications of form, structure, arrangement, proportions, materials, and components and otherwise, used in the practice of the invention, which are particularly adapted to specific environments and operative requirements without departing from the spirit and scope of the present invention. For instance, various other tools or other implements, such as an Allen Type, hex key-wrench or a clock or timing device, may be provided. The presently disclosed embodiments are therefore to be considered in all respects as illustrative and not respective, the scope of the invention being indicated by the appended claims, and not limited to the foregoing description.

While this invention has been described with emphasis on the preferred embodiments, it should be understood that within the scope of the appended claims, the invention might be practiced other than as specifically described herein.

What is claimed is:

1. A multiple function tool for use with computer systems comprising, a. a housing having a cover plate and a back plate connected by a plurality of rivets;

b. as a unit, a plurality of implements connected to the housing, wherein the plurality of implements comprises:

i. a flashlight;

ii. a chip puller;

iii. a first screwdriver having a small Phillips head;

iv. a second screwdriver forming a small flat head;

v. a continuity tester with an indicator light;

vi. a wire stripper;

vii. a crimper; and viii. a laptop case cracker; and c. wherein the plurality of implements are pivotably coupled to the plurality of rivets; and d. the flashlight is positioned on the cover plate.

2. The multiple function tool of claim 1, further comprising a password mnemonic mounted to the housing.

3. The multiple function tool of claim 1, further comprising a battery compartment for receiving a battery for the flashlight.

4. The multiple function tool of claim 1, wherein the wire stripper is able to strip wire size less than or equal to 24-gage wire.

5. The multiple function tool of claim 1, further comprising an Ethernet connector tester with a connector and a *Light Emitting Diode "LED"* light for indicating a working circuit.

6. The multiple function tool of claim 5, wherein the connector is a *Registered Jack* 45 "*RJ*45" connector.

7. The multiple function tool of claim 5, wherein the Ethernet connector tester is pivotably coupled to the multiple function tool such that pivoting of the Ethernet connector tester away from the multiple function tool permits access to the connector's interior.

8. The multiple function of claim 1, further comprising a cable pin insertion device.

9. The multiple function tool of claim 1, further comprising a removable writing implement.

10. The multiple function tool of claim 9, wherein the removable writing implement includes a slot for storing the removable writing implement.

11. The multiple function tool of claim 1, further comprising a deployable implement pivotably secured to the multiple function tool that is selected from the group consisting of a cutting blade and a cap lifter.

12. The multiple function tool of claim 1, wherein the flashlight includes a flashlight actuator arranged for activating and deactivating the flashlight.

13. The multiple function tool of claim 1, wherein the crimper is adapted for Ethernet cable and telephone cable crimping.

14. The multiple function tool of claim 1, wherein the continuity tester comprises two retractable wires each having a contact for engaging a circuit, wherein the contacts are for connecting an indicator light to indicate signal continuity in a test.

15. The multiple function tool of claim 14, further comprising a third screwdriver forming a larger flat head.

16. The multiple function tool of claim 1, further comprising a torx screwdriver.

17. A multiple function tool for use on computers comprising:

a. a housing;

b. a plurality of elements pivotably connected to the housing comprising a cover plate and a back plate connected by a plurality of rivets, consisting of:

i. a flashlight;

ii. a chip puller;

iii. a first screwdriver having a small Phillips head;

iv. a second screwdriver forming a small flat head;

v. a password mnemonic;

vi. a cable pin insertion device;

vii. an Ethernet connector tester with a connector and a light indicator for indicating a working circuit;

viii. a continuity tester with an indicator light;

ix. a wire stripper;

x. a crimper; and xi. a laptop case cracker, and c. wherein the plurality of elements are pivotably coupled to the multiple function tool; and d. the flashlight has a reflector and is positioned such that the flashlight and the reflector are on a face of the multiple function tool.

* * * * *